US005935022A

United States Patent [19]

Sugimoto et al.

[11] Patent Number: 5,935,022

[45] Date of Patent: Aug. 10, 1999

[54] THREE-PIECE SOLID GOLF BALL

[75] Inventors: Kazushige Sugimoto, Shirakawa; Yoshimasa Koizumi, Fukuchiyama, both of Japan

[73] Assignee: Sumitomo Rubber Industries, Ltd., Hyogo-Ken, Japan

[21] Appl. No.: 08/916,225

[22] Filed: Aug. 22, 1997

[30] Foreign Application Priority Data

Aug. 22, 1996 [JP] Japan ..... 8-221241

[51] Int. Cl.[6] ..... A63B 37/06

[52] U.S. Cl. ..... 473/373; 473/374; 473/378

[58] Field of Search ..... 473/373, 374, 473/378

[56] References Cited

U.S. PATENT DOCUMENTS 5,439,227 8/1995 Egashira et al. .

5,702,311 12/1997 Higuchi et al. ..... 473/373

5,730,664 3/1998 Asakura et al. ..... 473/373

5,733,205 3/1998 Higuchi et al. ..... 473/373 X

FOREIGN PATENT DOCUMENTS 0661083 7/1995 European Pat. Off. .

2300574 11/1996 United Kingdom .

*Primary Examiner*—George J. Marlo

[57] ABSTRACT

A three-piece solid golf ball having good shot feel and excellent rebound characteristics, while maintaining the characteristics inherent to the solid golf ball, i.e., excellent flight performance and good durability, wherein the gold ball has a core, an intermediate layer formed on the core, and a cover covering the intermediate layer. The core has a diameter of 30 to 36 mm and a specific gravity less than that of the intermediate layer; a ratio of the intermediate layer-covered core deformation amount/the core deformation amount within the range of 0.75 to 1, and a golf ball having a deformation amount of 2.3 to 3.5 mm, all deformations being measured when applying a load of 130 kgf.

6 Claims, 1 Drawing Sheet

$$\frac{\text{DEFORMATION OF CORE (1) PLUS INTERMEDIATE LAYER (2)}}{\text{DEFORMATION OF CORE (1)}} = 0.75-1.00$$

GOLF BALL DEFORMATION = 2.3 - 3.5 mm $$\frac{\text{DEFORMATION OF CORE (1) PLUS INTERMEDIATE LAYER (2)}}{\text{DEFORMATION OF CORE (1)}} = 0.75-1.00$$

GOLF BALL DEFORMATION = 2.3 - 3.5 mm

THREE-PIECE SOLID GOLF BALL

FIELD OF THE INVENTION

The present invention relates to a three-piece solid golf ball. More particularly, it relates to a three-piece solid golf ball having good shot feel and excellent rebound characteristics, while keeping the characteristics inherent to the solid golf ball, i.e. excellent flight performance and good durability.

BACKGROUND OF THE INVENTION

Many golf balls are commercially selling, but they are typically classified into two-piece solid golf ball and thread wound golf balls. The two-piece solid golf ball consists of a solid core of molded rubber material and a cover of thermoplastic resin (e.g. ionomer resin) covering on the solid core. The thread wound golf ball consists of a solid or liquid center, a thread wound layer formed on the center and a cover of ionomer resin or balata etc. having a thickness of 1 to 2 mm covering on the thread wound layer. The two-piece solid golf ball, when compared with the thread wound golf ball, has better durability and better flight performance because of a larger initial velocity when hitting and a longer flight distance. The two-piece solid golf ball is generally approved or employed by many golfers, especially amateur golfers. On the other hand, the two-piece solid golf ball has poor shot feel at the time of hitting and poor controllability for approach shots because of a smaller amount of spin. The thread wound golf ball has better shot feel and controllability for approach shots compared to the two-piece solid golf ball, but less flight distance and less durability.

In order to provide a two-piece solid golf ball having a shot feel as good as the thread wound golf ball, a soft type two-piece solid golf ball using a softer core has been proposed. However, a use of the soft core adversely affects the rebound characteristics, thus resulting in a reduction in the of flight distance and a deterioration in the durability.

It has been proposed to place an intermediate layer between the core and the cover of the two-piece solid golf ball to maintain the balance between flight performance and shot feel at the time of hitting. For example, Japanese Patent Kokai Publication No. 194760/1984 suggests a three-piece solid golf ball in which the core is made harder from its center toward the surface and the specific gravity of the intermediate layer is higher than the core. The resulting golf ball has a soft shot feel, but the durability is not sufficient to endure repeated hitting with a golf club, because the hardness of the center point of the core is lower than that of the surface. Japanese Patent Kokai Publication No. 80377/1989 suggests a three-piece solid golf ball having a Shore D hardness difference between the core and the intermediate layer of not less than 20. However, since the difference in the hardness is too large, the difference in the deformation amount between the core and the intermediate layer is so large that the durability is extremely degraded when hitting the golf ball with a golf club. Accordingly, the durability is not sufficient to endure repeated hitting with a golf club.

OBJECTS OF THE INVENTION

A main object of the present invention is to provide a three-piece solid golf ball having good shot feel and excellent rebound characteristics, while manufacturing the characteristics inherent in the solid golf ball, i.e. excellent flight performance and good durability.

According to the present invention, the object described above has been accomplished by adjusting the diameter of the core, the difference in the specific gravity between the core and the intermediate layer, and the deformation amount of the core and the intermediate layer with a specified range, thereby providing a three-piece solid golf ball having good shot feel and excellent rebound characteristics, while maintaining the characteristics inherent in the solid golf ball, i.e. excellent flight performance and good durability.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
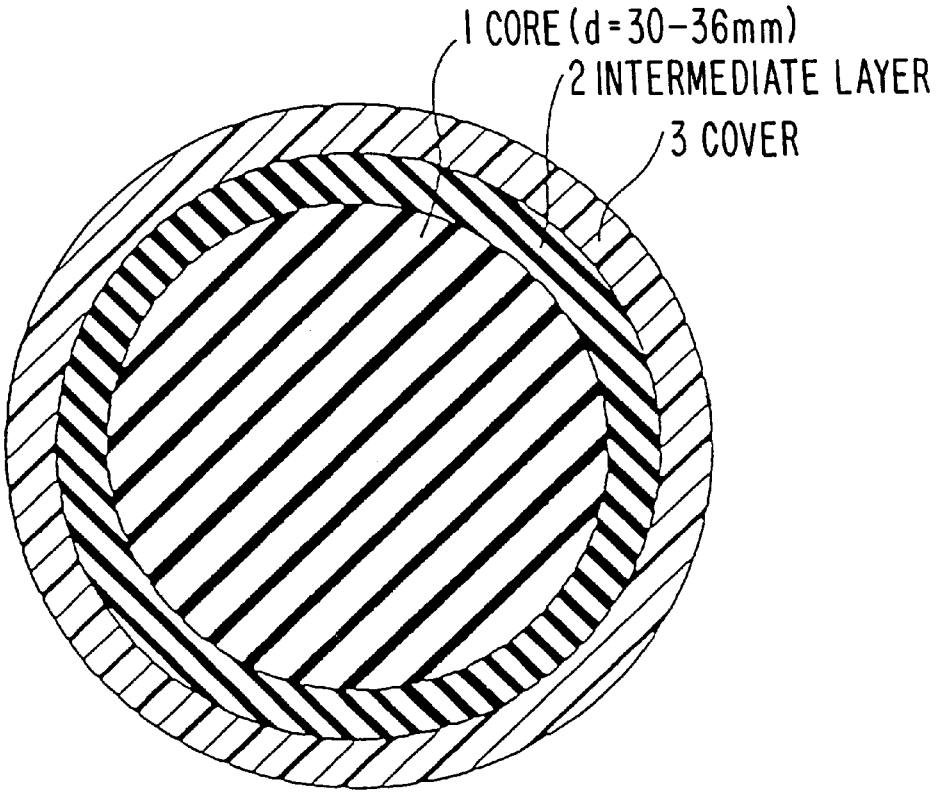
FIG. 1 is a schematic cross section illustrating one embodiment of the golf ball of the present invention.

The present invention provides a three-piece solid golf ball comprising a core, an intermediate layer formed on the core, and a cover covering the intermediate layer, wherein the core has a diameter of 30 to 36 mm and a specific gravity less than that of the intermediate layer, in case where the deformation amount (mm) of the core when applying 130 kgf to the core is determined, and where the deformation amount (mm) of the intermediate layer-covered core when applying 130 kgf to the intermediate layer-covered core is determined, the ratio of the intermediate layer-covered core deformation amount/the core deformation amount is within the range of 0.75 to 1, and the golf ball has a deformation amount of 2.3 to 3.5 mm when applying a load of 130 kgf.

DETAILED DESCRIPTION OF THE INVENTION

The three-piece solid golf ball of the present invention will be explained with reference to the accompanying drawing. FIG. 1 is a schematic cross section illustrating one embodiment of the golf ball of the present invention. In FIG. 1, element 1 is the core, element 2 is the intermediate layer and element 3 is the cover.

The both of core 1 and the intermediate layer 2 are obtained by vulcanizing or press-molding a rubber composition by employing methods and conditions which have been used for conventional solid golf balls. The rubber composition typically comprises a base rubber, a crosslinking agent, a metal salt of an unsaturated carboxylic acid, optionally a filler and an antioxidant, and the like. The base rubber may be natural rubber and/or synthetic rubber which has been conventionally used for solid golf balls. Preferred is high-cis polybutadiene rubber containing a cis-1,4 bond of not less than 40%, preferably not less than 80%. The base rubber may be mixed with natural rubber, polyisoprene rubber, styrene-butadiene rubber, ethylene-propylenediene rubber (EPDM), and the like.

The crosslinking agents may be an organic peroxide such as dicumyl peroxide, t-butyl peroxide and the like. The preferred organic peroxide is dicumyl peroxide. The amount of the organic peroxide is preferably from 0.5 to 2.0 parts by weight for the core 1, and from 1.0 to 3.0 parts by weight for the intermediate layer 2, based on 100 parts by weight of the base rubber. When the amount of the organic peroxide is smaller than 0.5 parts by weight for the core 1 and smaller than 1.0 parts by weight for the intermediate layer 2, the core is too soft. Therefore, the rebound characteristics are degraded which reduce flight distance. On the other hand, when the amount of the organic peroxide is larger than 2.0 parts by weight for the core 1 and larger than 3.0 parts by weight for the intermediate layer 2, the core is too hard. Therefore, shot feel is poor.

The metal salt of the unsaturated carboxylic acid, which acts as a co-crosslinking agent, includes mono or divalent metal salts, such as zinc or magnesium salts of α,β-unsaturated carboxylic acids having 3 to 8 carbon atoms (e.g. acrylic acid, methacrylic acid, etc.). Preferred co-crosslinking agent is zinc diacrylate because it imparts high rebound characteristics to the resulting golf ball. An amount of the metal salt of the unsaturated carboxylic acid in the rubber composition is 10 to 30 parts by weight, preferably from 20 to 30 parts by weight for the core 1 and 20 to 35 parts by weight, preferably from 25 to 35 parts by weight for the intermediate layer 2, based on 100 parts by weight of the base rubber. When the amount of the metal salt of the unsaturated carboxylic acid is larger than 30 parts by weight for the core 1 and larger than 35 parts by weight for the intermediate layer 2, the core is too hard. Therefore, shot feel is poor. On the other hand, when the amount of the metal salt of the unsaturated carboxylic acid is smaller than 15 parts by weight for the core 1 and smaller than 20 parts by weight for the intermediate layer 2, the core is soft. Therefore the rebound characteristics are degraded which reduces flight distance.

The filler, which can be used for the core of golf ball, includes for example, an inorganic filler (such as zinc oxide, barium sulfate, calcium carbonate, magnesium oxide and the like), a high specific gravity metal powder filler (such as powdered tungsten, powdered molybdenum, and the like), and the mixture thereof. The amount of the filler is not limited and can vary depending on the specific gravity and size of the cover and core, but is from 3 to 15 parts by weight, preferably from 3 to 10 parts by weight for the core 1 and 5 to 25 parts by weight for the intermediate layer 2, based on 100 parts by weight of the base rubber. When the amount of the filler is smaller than 3 parts by weight for the core 1 and smaller than 5 parts by weight for the intermediate layer 2, the core is too light. Therefore, the resulting golf ball is too light. On the other hand, when the amount of the filler is larger than 15 parts by weight for the core 1 and larger than 25 parts by weight for the intermediate layer 2, the core is too heavy. Therefore, the resulting golf ball is too heavy. In the present invention, since the intermediate layer 2 has a specific gravity larger than that of the core 1, it is preferable to formulate a high specific gravity metal powder filler having a specific gravity of not less than 10, preferably 15 to 25 in the intermediate layer 2. When the specific gravity of the high specific gravity metal powder filler is lower than 10, the amount of the filler is too large and a rubber content per total composition is small, thus degrading the rebound characteristics. The amount of the high specific gravity metal powder filler is not limited and can vary depending on the specific gravity of the high specific gravity metal powder filler, but is preferably from 5 to 100 parts by weight, based on 100 parts by weight of the base rubber.

The rubber composition for the core and the intermediate layer of the present invention can contain other components which have been conventionally used for preparing the core of solid golf balls, such as antioxidants or peptizing agents. If used, an amount of the antioxidant is preferably 0.2 to 1.5 parts by weight based on 100 parts by weight of the base rubber.

In the three-piece solid present invention, the core has a diameter of 30 to 36 mm, preferably 30 to 35 mm. When the diameter of the core is smaller than 30 mm, a sufficient effect of increasing moment of inertia is not obtained. On the other hand, when the diameter of the core is larger than 36 mm, the thickness of the intermediate layer decreases. Therefore, a sufficient effect of the intermediate layer is not obtained. Further, the core preferably has a difference in JIS-C hardness between the center point and the surface of not more than 5. When the hardness difference is more than 5, the durability of the golf ball is degraded. In the golf ball of the present invention, the core has a deformation amount, when applying a load of 130 kgf, of 3.6 to 4.8 mm, preferably 3.8 to 4.6 mm. When the deformation amount is smaller than 3.6, the resulting golf ball is too hard and the shot feel is degraded. On the other hand, when the deformation amount is larger than 4.8, the rebound characteristics and durability of the resulting golf ball are degraded.

A method of forming the intermediate layer of the present invention is not specifically limited, but may be a conventional method of forming a cover of golf ball. For example, there can be used a method which comprises the steps of molding the composition for the intermediate layer into a semi-spherical half-shell in advance, covering a solid core with two half-shells, followed by pressure molding, or a method of injection molding the composition for the intermediate layer directly on the core to cover it.

In the three-piece solid present invention, the intermediate layer has a specific gravity of not less than 1.2, preferably 1.2 to 1.4, and the specific gravity is larger than that of the core. A diameter of the intermediate layer-covered core is ranged within preferably 38.0 to 40.0 mm. Since the diameter of the core is within the range of 30 to 36 mm as described above, the thickness of the intermediate layer is within the range of 1.0 to 5.0 mm, preferably 1.5 to 5.0 mm. When the thickness of the intermediate layer is smaller than 1.0 mm, the shot feel is degraded. On the other hand, when the thickness is larger than 4.0 mm, the resulting golf ball is too soft and the rebound characteristics are degraded, thus reducing flight performance. A deformation amount of the intermediate layer formed on the core, when applying a load of 130 kgf, is within the range of 3.0 mm to 4.5 mm, preferably 3.2 to 4.4 mm. When the deformation amount is smaller than 3.0, the resulting golf ball is too hard and the shot feel is degraded. On the other hand, when the deformation amount is larger than 4.5, the rebound characteristics and durability of the resulting golf ball are degraded. Further, the surface JIS-C hardness of the intermediate layer-covered core is within the range of 70 to 90, preferably 73 to 87. When the surface hardness is larger than 90, the shot feel of the resulting golf ball is degraded. On the other hand, when the surface hardness is smaller than 70, the resulting golf ball is too soft and the rebound characteristics are degraded, thus reducing flight performance.

In both the core 1 and the intermediate layer 2, it is preferable that the specific gravity of the core is smaller than that of the intermediate layer, and the diameter of the core is within the range of 30 to 36 mm. This is for the following reasons. Golf balls, when hit by a golf club, fly while maintaining a certain spin amount is, but the spin amount gradually reduced by air resistance and the like, whereby the spin amount when dropping on the ground is generally smaller than at the time when the ball is hit. If the spin amount on the ball when it drops to the ground is too small, the lifting power of the golf ball is lost lose and the flight distance is reduced because of the immediate reduction of the flight power of the golf ball before it drops to the ground.

Thus, if a reduction of the spin amount is restrained as much as possible, the flight power of the golf ball is maintain for a longer time and the flight distance increases. It is desired to restrain a reduction in the spin amount as much as possible for that purpose, for which it is necessary to increase the moment of inertia of the golf ball and to improve the capability of maintaining the spin amount. Therefore, it is required to distribute the weight to the outside as far as possible in the golf ball. For the above reasons, it is preferred that the diameter of the core which has a smaller specific gravity than the intermediate layer is made as large as possible, and the thickness of the intermediate layer which has a larger specific gravity than the core is made as small as possible.

In the deformation amount of the core 1 and the deformation amount of the intermediate layer-covered core when applying a load of 130 kgf, the ratio of the deformation amount of the intermediate layer-covered core/the deformation amount of the core is preferably within the range of 0.75 to 1. When the ratio is smaller than 0.75, the deformation amount of the core is larger than that of the intermediate layer-covered core and therefore, the durability of the ball is not sufficient for practical use. On the other hand, when the ratio is larger than 1, the deformation amount of the intermediate layer-covered core is larger than that of the core and therefore the rebound characteristics of the resulting golf ball are degraded.

The cover is generally formed from an ionomer which is known in the art and has been used for the cover of golf balls. The ionomer resin used in the present invention is not limited, but includes an ethylene-(meth)acrylic acid copolymer, of which a portion of carboxylic acid groups is neutralized with metal ion, or mixtures thereof. The metal ion which neutralizes a portion of carboxylic acid groups of the copolymer includes an alkaline metal ion, such as a sodium ion, a potassium ion, a lithium ion and the like; a divalent metal ion, such as a zinc ion, a calcium ion, a magnesium ion, and the like; a trivalent metal ion, such as an aluminum ion, a neodymium ion, and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resin, which is commercially available from Exxon Chemical Co., include Iotek 7010, Iotek 8000, and the like. These ionomer resins are used alone or in combination.

The cover used in the present invention may optionally contain fillers (such as barium sulfate, etc.), pigments (such as titanium dioxide, etc.), and the other additives such as a dispersant, an antioxidant, a UV absorber, a photostabilizer and a fluorescent agent or a fluorescent brightener, etc., in addition to the resin component, as long as the addition of the additive does not deteriorate the desired performance of the golf ball cover. However, the amount of the pigment is preferably from 0.1 to 0.5 parts by weight based on 100 parts by weight of the base rubber.

As a method of covering the core, the same method as that of forming the intermediate layer described above may be used. The cover thus formed preferably has a Shore D hardness of 60 to 75. When the hardness of the cover is smaller than 60, the rebound characteristics of the resulting golf ball is degraded and reduces the flight performance. On the other hand, when the hardness is larger than 75, the resulting golf ball is too hard. Therefore the shot feel is degraded. At the time of molding the cover, many depressions called "dimples" may be optionally formed on the surface of the golf ball. The golf ball of the present invention has a deformation amount, when applying a load of 130 kgf, of 2.3 to 3.5 mm, preferably 2.6 to 3.4 mm. When the deformation amount of the golf ball is smaller than 2.3 mm, the shot feel is degraded. On the other hand, when the deformation amount of the golf ball is larger than 3.5 mm, the deformation amount when hitting is also increased. Therefore, the durability is degraded. Furthermore, paint finishing or with a marking with a stamp may be optionally provided after the cover is molded for commercial purpose.

EXAMPLES

The following Examples and Comparative Examples further illustrate the present invention in detail but are not to be construed to limit the scope thereof.

Production of Cores

Each solid core was prepared by mixing the rubber composition for core described in Tables 1 to 4 and vulcanizing the mixture at the condition described there. A JIS-C hardness distribution from the center to the surface of the resulting core was determined, and the results are shown in Tables 1 to 4. Diameter, deformation amount when applying a load of 130 kgf and specific gravity of the cores were determined, and the results are shown in Tables 6 to 10.

Formation of Intermediate Layers

Each intermediate layer was formed on the above core by injection molding the rubber composition for intermediate layer described in Tables 1 to 4 (diameter of 38.4 mm). The composition of the intermediate layer used, vulcanization condition and JIS-C hardness of the surface of the resulting intermediate layers are shown in Tables 1 to 4. Deformation amount when applying a load of 130 kgf and specific gravity of the intermediate layers were determined, and the results are shown in Tables 6 to 10.

TABLE 1

| Example No. | 1 | 2 | 3 |
|---|---|---|---|
| (Core) | | | |
| Butadiene rubber*1 | 100 | 100 | 100 |
| Zinc acrylate | 25 | 25 | 26 |
| Zinc oxide | 5 | 5 | 5 |
| Antioxidant*2 | 0.5 | 0.5 | 0.5 |
| Dicumyl peroxide | 1.2 | 1.2 | 1.2 |
| Vulcanization condition (° C. × minutes) | 142 × 20 +165 × 8 | 142 × 23 +165 × 8 | 140 × 22 +165 × 8 |
| Hardness distribution | | | |
| Center point | 72 | 73 | 74 |
| 5 mm from the center point | 72 | 73 | 74 |
| 10 mm from the center point | 73 | 73 | 74 |
| 15 mm from the center point | 73 | 73 | 74 |
| (Intermediate layer) | | | |
| Butadiene rubber | 100 | 100 | 100 |
| Zinc acrylate | 30 | 30 | 30 |
| Zinc oxide | 33 | 21 | 9 |
| Tungsten | 10 | 20 | 30 |
| Antioxidant | 0.5 | 0.5 | 0.5 |
| Dicumyl peroxide | 2.0 | 2.0 | 2.0 |

TABLE 1-continued

| Example No. | 1 | 2 | 3 |
|---|---|---|---|
| Vulcanization condition (° C. × minutes) | 160 × 20 | 150 × 20 | 150 × 20 |
| Surface hardness (JIS-C) | 85 | 77 | 76 |

TABLE 2

| Example No. | 4 | 5 |
|---|---|---|
| (Core) | | |
| Butadiene rubber*1 | 100 | 100 |
| Zinc acrylate | 27 | 25 |
| Zinc oxide | 5 | 5 |
| Antioxidant*2 | 0.5 | 0.5 |
| Dicumyl peroxide | 1.2 | 1.2 |
| Vulcanization condition (° C. × minutes) | 140 × 21 +165 × 8 | 145 × 28 |
| Hardness distribution | | |
| Center point | 75 | 68 |
| 5 mm from the center point | 75 | 70 |
| 10 mm from the center point | 75 | 71 |
| 15 mm from the center point | 75 | 72 |
| (Intermediate layer) | | |
| Butadiene rubber | 100 | 100 |
| Zinc acrylate | 30 | 30 |
| Zinc oxide | — | — |
| Tungsten | 37 | 37 |
| Antioxidant | 0.5 | 0.5 |
| Dicumyl peroxide | 2.0 | 2.0 |
| Vulcanization condition (° C. × minutes) | 152 × 20 | 150 × 20 |
| Surface hardness (JIS-C) | 76 | 75 |

TABLE 3

| Comparative Example No. | 1 | 2 | 3 | 4 |
|---|---|---|---|---|
| (Core) | | | | |
| Butadiene rubber*1 | 100 | 100 | 100 | 100 |
| Zinc acrylate | 23 | 21 | 27 | 20 |
| Zinc oxide | 23 | 5 | 5 | 5 |
| Antioxidant*2 | 0.5 | 0.5 | 0.5 | 0.5 |
| Dicumyl peroxide | 1.2 | 1.2 | 1.2 | 1.2 |
| Vulcanization condition (° C. × minutes) | 142 × 20 +165 × 8 | 140 × 24 +165 × 8 | 140 × 22 +165 × 8 | 140 × 25 +165 × 8 |
| Hardness distribution | | | | |
| Center point | 72 | 70 | 74 | 68 |
| 5 mm from the center point | 72 | 70 | 75 | 69 |
| 10 mm from the center point | 73 | 70 | 75 | 69 |
| 15 mm from the center point | 73 | 70 | 75 | 69 |
| (Intermediate layer) | | | | |
| Butadiene rubber | 100 | 100 | 100 | 100 |
| Zinc acrylate | 30 | 30 | 30 | 30 |
| Zinc oxide | 21 | 21 | 9 | 3 |
| Tungsten | — | 20 | 30 | 37 |
| Antioxidant | 0.5 | 0.5 | 0.5 | 0.5 |

TABLE 3-continued

| Comparative Example No. | 1 | 2 | 3 | 4 |
|---|---|---|---|---|
| Dicumyl peroxide | 2.0 | 2.0 | 2.0 | 2.0 |
| Vulcanization condition (° C. × minutes) | 160 × 20 | 165 × 20 | 154 × 20 | 147 × 20 |
| Surface hardness (JIS-C) | 85 | 88 | 81 | 74 |

TABLE 4

| Comparative Example No. | 5 | 6 | 7 | 8 |
|---|---|---|---|---|
| (Core) | | | | |
| Butadiene rubber*1 | 100 | 100 | 100 | 100 |
| Zinc acrylate | 24 | 29 | 23 | 25 |
| Zinc oxide | 5 | 5 | 5 | 5 |
| Antioxidant*2 | 0.5 | 0.5 | 0.5 | 0.5 |
| Dicumyl peroxide | 1.2 | 1.2 | 1.2 | 1.2 |
| Vulcanization condition (° C. × minutes) | 140 × 23 +165 × 8 | 140 × 21 +165 × 8 | 140 × 20 +165 × 8 | 148 × 28 |
| Hardness distribution | | | | |
| Center point | 72 | 78 | 72 | 65 |
| 5 mm from the center point | 72 | 78 | 73 | 67 |
| 10 mm from the center point | 72 | 78 | 73 | 69 |
| 15 mm from the center point | 72 | 79 | 73 | 72 |
| (Intermediate layer) | | | | |
| Butadiene rubber | 100 | 100 | 100 | 100 |
| Zinc acrylate | 30 | 25 | 30 | 30 |
| Zinc oxide | — | 17 | 21 | 21 |
| Tungsten | 37 | 20 | 20 | 20 |
| Antioxidant | 0.5 | 0.5 | 0.5 | 0.5 |
| Dicumyl peroxide | 2.0 | 2.0 | 2.0 | 2.0 |
| Vulcanization condition (° C. × minutes) | 150 × 20 | 143 × 20 | 160 × 20 | 152 × 20 |
| Surface hardness (JIS-C) | 77 | 54 | 85 | 79 |

*1: Polybutadiene (trade name "BR-18") from Japan Synthetic Rubber Co., Ltd.
*2: Antioxidant (trade name "Yoshinox 425") from Yoshitomi Pharmaceutical Inds., Ltd.

(Examples 1 to 5 and Comparative Examples 1 to 8)

The cover composition described in Table 5 were injection molded on the resulting intermediate layers to obtain three-piece solid golf balls having a diameter of 42.76 mm. Shore D hardness of the cover, deformation amount when applying a load of 130 kgf, moment of inertia, durability, coefficient of restitution, flight performance (launch angle, spin amount, carry, total and run) and shot feel were measured or evaluated, and the results are shown in 6 to 10. The test methods are as follows.

TABLE 5

| Kind | a | b | c | d | e |
|---|---|---|---|---|---|
| Hi-milan 1706*3 | — | 60 | 44 | 30 | — |
| Hi-milan 1605*4 | 5 | — | 44 | 35 | — |
| Hi-milan 1555*5 | 10 | — | 6 | — | — |
| Hi-milan 1557*6 | — | — | 6 | — | — |
| Hi-milan 1705*7 | — | 20 | — | — | — |
| Hi-milan 1855*8 | 85 | 20 | — | — | — |
| Hi-milan AM7317*9 | — | — | — | 35 | — |
| Hi-milan AM7315*10 | — | — | — | — | 50 |
| Iotek 8000*11 | — | — | — | — | 50 |

*3: Hi-milan 1706 (trade name), ethylene-methacrylic acid copolymer ionomer resin obtained by neutralizing with zinc ion, manufactured by Mitsui Du Pont Polychemical Co., Ltd.
*4: Hi-milan 1605 (trade name), ethylene-methacrylic acid copolymer ionomer resin obtained by neutralizing with sodium ion, manufactured by Mitsui Du Pont Polychemical Co., Ltd.
*5: Hi-milan 1555 (trade name), ethylene-methacrylic acid copolymer ionomer resin obtained by neutralizing with sodium ion, manufactured by Mitsui Du Pont Polychemical Co., Ltd.
*6: Hi-milan 1557 (trade name), ethylene-methacrylic acid copolymer ionomer resin obtained by neutralizing with zinc ion, manufactured by Mitsui Du Pont Polychemical Co., Ltd.
*7: Hi-milan 1705 (trade name), ethylene-methacrylic acid copolymer ionomer resin obtained by neutralizing with zinc ion, manufactured by Mitsui Du Pont Polychemical Co., Ltd.
*8: Hi-milan 1855 (trade name), ethylene-butyl acrylate-methacrylic acid terpolymer ionomer resin obtained by neutralizing with zinc ion, manufactured by Mitsui Du Pont Polychemical Co., Ltd.
*9: Hi-milan AM7317 (trade name), ethylene-methacrylic acid copolymer ionomer resin obtained by neutralizing with zinc ion, manufactured by Mitsui Du Pont Polychemical Co., Ltd.
*10: Hi-milan AM7315 (trade name), ethylene-methacrylic acid copolymer ionomer resin obtained by neutralizing with zinc ion, manufactured by Mitsui Du Pont Polychemical Co., Ltd.
*11: Iotek 8000 (trade name), ethylene-acrylic acid copolymer ionomer resin obtained by neutralizing with sodium ion, manufactured by Exxon Chemical Co.

Test Method (1) Moment of Inertia

The moment of inertia was measured by Model No. 005-002, Series No. M99274, available from Inertia Dynamics.

(2) Durability

A golf ball was put into a tube, and fired by air to strike against an impact board, repeatedly. The durability is the number of strike until the golf ball cracks, and is indicated by an index when that of Comparative example 5 is 100. When the number is more than 100, the golf ball can be put to practice use.

(3) Coefficient of restitution

An aluminum cylinder having a weight of 198.45 g was fired to strike against a golf ball at a speed of 45 cm/sec, and the velocity of the golf ball after strike was measured. The coefficient of restitution of the golf ball was calculated from the velocity and the weight of the cylinder and golf ball, and was indicated by an index when that of Example 1 was 100.

(4) Flight Performance

After a No. 1 wood club was mounted to a swing robot manufactured by True Temper Co. and a golf ball was hit at a head speed of 40 m/second, the launch angle, spin amount and flight distances are measured. The spin amount was measured by continuously taking a photograph of a mark provided on the hit golf ball using a high-speed camera. As the flight distances, carry which is a distance to the dropping point of the hit golf ball, and total (total distance) are measured. Run is a distance subtracted carry from total.

(5) Shot feel

The shot feel of the golf ball is evaluated by 10 professional golfers according to a practical hitting test using a No. 1 wood club. The evaluation criteria are as follows. The results shown in the Tables below are based on the fact that not less than 8 out of 10 professional golfers evaluated with the same criterion about each test item.

Evaluation criteria

◎: Very good

○: Good x: Hard and poor

TABLE 6

| Example No. | 1 | 2 | 3 |
|---|---|---|---|
| Diameter of core (mm) | 30.5 | 31.5 | 33.0 |
| Deformation amount (mm) | | | |
| Core | 4.20 | 4.15 | 4.05 |
| Intermediate layer | 3.50 | 3.85 | 3.70 |
| Golf ball | 2.60 | 2.95 | 2.83 |
| Intermediate layer/core | 0.83 | 0.93 | 0.91 |
| Specific gravity | | | |
| Core | 1.05 | 1.05 | 1.10 |
| Intermediate layer | 1.29 | 1.32 | 1.29 |
| Moment of inertia ($gcm^2$) | 83.9 | 83.6 | 83.3 |
| Kind of cover | b | c | d |
| Shore D Hardness of cover | 65 | 69 | 70 |
| Durability | 150 | 120 | 120 |
| Coefficient of restitution | 0.7701 | 0.7721 | 0.7734 |
| Flight performance (W #1, 40 m/s) | | | |
| Launch angle | 13.05 | 12.95 | 12.90 |
| Spin amount | 2350 | 2310 | 2360 |
| Flight distance (yard) | | | |
| Carry | 203.0 | 203.8 | 204.1 |
| Total | 231.0 | 232.9 | 234.3 |
| Run | 28.0 | 29.1 | 30.2 |
| Shot feel | ○ | ◎ | ○ |
| Durability evaluation | ○ | ○ | ○ |
| Flight performance evaluation | ○ | ○ | ○ |
| Comprehensive evaluation | ○ | ○ | ○ |

TABLE 7

| Example No. | 4 | 5 |
|---|---|---|
| Diameter of core (mm) | 35.0 | 35.0 |
| Deformation amount (mm) | | |
| Core | 3.95 | 4.25 |
| Intermediate layer | 3.85 | 4.00 |
| Golf ball | 2.95 | 3.10 |
| Intermediate layer/core | 0.97 | 0.94 |
| Specific gravity | | |
| Core | 1.10 | 1.10 |
| Intermediate layer | 1.39 | 1.39 |
| Moment of inertia ($gcm^2$) | 83.6 | 83.6 |
| Kind of cover | d | e |
| Shore D Hardness of cover | 70 | 73 |
| Durability | 115 | 110 |
| Coefficient of restitution | 0.7726 | 0.7712 |
| Flight performance (W #1, 40 m/s) | | |
| Launch angle | 12.80 | 12.93 |
| Spin amount | 2268 | 2288 |
| Flight distance (yard) | | |
| Carry | 203.9 | 203.6 |
| Total | 235.1 | 235.1 |
| Run | 31.2 | 31.5 |

TABLE 7-continued

| Example No. | 4 | 5 |
|---|---|---|
| Shot feel | ◎ | ◎ |
| Durability evaluation | ○ | ○ |
| Flight performance evaluation | ○ | ○ |
| Comprehensive evaluation | ○ | ○ |

TABLE 8

| Comparative example No. | 1 | 2 | 3 |
|---|---|---|---|
| Diameter of core (mm) | 30.5 | 31.5 | 33.0 |
| Deformation amount (mm) | | | |
| Core | 4.20 | 4.59 | 3.40 |
| Intermediate layer | 3.50 | 3.40 | 3.00 |
| Golf ball | 2.60 | 2.60 | 2.10 |
| Intermediate layer/core | 0.83 | 0.74 | 0.88 |
| Specific gravity | | | |
| Core | 1.15 | 1.05 | 1.10 |
| Intermediate layer | 1.15 | 1.32 | 1.29 |
| Moment of inertia ($gcm^2$) | 80.3 | 83.6 | 83.3 |
| Kind of cover | d | d | d |
| Shore D Hardness of cover | 70 | 70 | 70 |
| Durability | 110 | 85 | 145 |
| Coefficient of restitution | 0.7738 | 0.7713 | 0.7750 |
| Flight performance (W #1, 40 m/s) | | | |
| Launch angle | 13.02 | 13.12 | 12.92 |
| Spin amount | 2258 | 2345 | 2356 |
| Flight distance (yard) | | | |
| Carry | 203.5 | 203.9 | 203.8 |
| Total | 229.5 | 233.9 | 233.3 |
| Run | 26.0 | 30.0 | 29.5 |
| Shot feel | ○ | ○ | x |
| Durability evaluation | ○ | x | ○ |
| Flight performance evaluation | x | ○ | ○ |
| Comprehensive evaluation | x | x | x |

TABLE 9

| Comparative example No. | 4 | 5 | 6 |
|---|---|---|---|
| Diameter of core (mm) | 35.0 | 27.0 | 31.5 |
| Deformation amount (mm) | | | |
| Core | 4.65 | 4.25 | 3.40 |
| Intermediate layer | 4.50 | 4.00 | 3.70 |
| Golf ball | 3.60 | 3.10 | 2.80 |
| Intermediate layer/core | 0.97 | 0.94 | 1.09 |
| Specific gravity | | | |
| Core | 1.10 | 1.05 | 1.05 |
| Intermediate layer | 1.39 | 1.18 | 1.32 |
| Moment of inertia ($gcm^2$) | 83.6 | 81.6 | 83.6 |
| Kind of cover | d | d | d |
| Shore D Hardness of cover | 70 | 70 | 70 |
| Durability | 80 | 100 | 110 |
| Coefficient of restitution | 0.7696 | 0.7702 | 0.7650 |
| Flight performance (W #1, 40 m/s) | | | |
| Launch angle | 12.91 | 13.05 | 12.35 |
| Spin amount | 2232 | 2267 | 2332 |
| Flight distance (yard) | | | |
| Carry | 203.7 | 203.2 | 202.5 |
| Total | 234.0 | 229.0 | 227.5 |
| Run | 30.3 | 25.8 | 25.1 |
| Shot feel | ○ | ○ | ○ |

TABLE 9-continued

| Comparative example No. | 4 | 5 | 6 |
|---|---|---|---|
| Durability evaluation | x | ○ | ○ |
| Flight performance evaluation | ○ | x | X |
| Comprehensive evaluation | x | x | x |

TABLE 10

| Comparative example No. | 7 | 8 |
|---|---|---|
| Diameter of core (mm) | 31.5 | 31.5 |
| Deformation amount (mm) | | |
| Core | 4.20 | 4.40 |
| Intermediate layer | 3.50 | 4.00 |
| Golf ball | 2.60 | 3.10 |
| Intermediate layer/core | 0.83 | 0.90 |
| Specific gravity | | |
| Core | 1.05 | 1.05 |
| Intermediate layer | 1.32 | 1.32 |
| Moment of inertia ($gcm^2$) | 83.6 | 83.6 |
| Kind of cover | a | d |
| Shore D Hardness of cover | 58 | 70 |
| Durability | 170 | 80 |
| Coefficient of restitution | 0.7602 | 0.7695 |
| Flight performance (W #1, 40 m/s) | | |
| Launch angle | 11.90 | 13.05 |
| Spin amount | 2651 | 2255 |
| Flight distance (yard) | | |
| Carry | 197.2 | 203.1 |
| Total | 220.3 | 232.8 |
| Run | 23.1 | 29.7 |
| Shot feel | ○ | ○ |
| Durability evaluation | ○ | x |
| Flight performance evaluation | x | ○ |
| Comprehensive evaluation | x | x |

As is apparent from Table 6 to Table 10, the golf balls of Examples 1 to 5 showed excellent flight performance and good durability, and good shot feel and excellent rebound characteristics.

To the contrary, in the golf ball of Comparative Example 1, the moment of inertia is smaller and the flight performance is poorer than that of the golf balls of Examples 1 to 5, because the specific gravity of the core is the same as that of the intermediate layer. The golf ball of Comparative Example 2 has poor durability in comparison with the golf balls of Examples 1 to 5, because the ratio of the deformation amount of the intermediate layer-covered core, when applying a load of 130 kgf, to the deformation amount of the core, when applying a load of 130 kgf, is less than 0.75. The golf ball of Comparative Example 3 has poor shot feel in comparison with the golf balls of Examples 1 to 5, because the deformation amount of the golf ball when applying a load of 130 kgf is less than 2.3 mm. The golf ball of Comparative Example 4 has poor durability in comparison with the golf balls of Examples 1 to 5, because the deformation amount of the golf ball when applying a load of 130 kgf is more than 3.5 mm. In the golf ball of Comparative Example 5, the moment of inertia is smaller and the flight performance is poorer than that of the golf balls of Examples 1 to 5, because the diameter of the core is less than 30 mm. The golf ball of Comparative Example 6 is poor in rebound characteristics and flight performance in comparison with the golf balls of Examples 1 to 5, because the ratio of the deformation amount of the intermediate layer-covered core, when applying a load of 130 kgf, to the deformation amount of the core, when applying a load of 130 kgf, is more than 1.0. The golf ball of Comparative Example 7 is poor in rebound characteristics and flight performance in comparison with the golf balls of Examples 1 to 5, because the hardness of the core is less than 60. The golf ball of Comparative Example 8 has poor durability in comparison with the golf balls of Examples 1 to 5, because a difference in hardness from the center point to the surface of the core is more than 5.

What is claimed is:

1. A three-piece solid golf ball comprising a core, an intermediate layer formed on the core, and a cover covering the intermediate layer, wherein the core has a diameter of 30 to 36 mm and a specific gravity less than that of the intermediate layer, and wherein in the case where the deformation amount (mm) of the core when applying 130 kgf to the core is determined, and where the deformation amount (mm) of the intermediate layer-covered core when applying 130 kgf to the intermediate layer-covered core is determined, the ratio of the intermediate layer-covered core deformation amount/the core deformation amount is within the range of 0.75 to 1, and the golf ball has a deformation amount of 2.3 to 3.5 mm when applying a load of 130 kgf.

2. The three-piece solid golf ball according to claim 1, wherein the core has a difference in JIS-C hardness from the center point to the surface thereof of less than 5.

3. The three-piece solid golf ball according to claim 1, wherein the cover has a Shore D hardness of 60 to 75.

4. The three-piece solid golf ball according to claim 1, wherein the intermediate layer comprises 5 to 100 parts by weight of a filler having a specific gravity of not less than 10, based on 100 parts by weight of a rubber component.

5. The three-piece solid golf ball according to claim 1, wherein the intermediate layer has a specific gravity of not less than 1.2.

6. The three-piece solid golf ball of claim 1, wherein the core and the intermediate layer are obtained by treating a base rubber with a cross-linking agent in an amount of from 0.5 to 2.0 parts by weight for the core and from 1.0 to 3.0 parts by weight for the intermediate layer based on 100 parts by weight of the base rubber.

* * * * *